US006066614A

United States Patent [19]

Orlandini et al.

[11] Patent Number: 6,066,614

[45] Date of Patent: May 23, 2000

[54] CLEANING COMPOSITIONS

[75] Inventors: Laura Orlandini, Bacoli, Italy; Marco Petri, Angera Varesem, Italy; Giuseppe Sirianni, Gimigliano, Italy

[73] Assignee: The Proctor & Gamble Company, Cincinnati, Ohio

[21] Appl. No.: 09/202,248

[22] PCT Filed: Jun. 6, 1997

[86] PCT No.: PCT/US97/09957

§ 371 Date: Feb. 24, 1999

§ 102(e) Date: Feb. 24, 1999

[87] PCT Pub. No.: WO97/47714

PCT Pub. Date: Dec. 18, 1997

[30] Foreign Application Priority Data

| | | | |
|---|---|---|---|
| Jun. 10, 1996 | [EP] | European Pat. Off. | 96870071 |
| Jul. 1, 1996 | [EP] | European Pat. Off. | 96870088 |

[51] Int. Cl.[7] ..... B08B 3/08; C11D 1/14; C11D 1/83; C11D 3/37; C11D 3/395

[52] U.S. Cl. ..... 510/405; 510/379; 510/414; 510/428; 510/434; 510/536; 134/40; 134/42

[58] Field of Search ..... 510/379, 405, 510/414, 428, 434, 536; 134/40, 42

[56] References Cited

U.S. PATENT DOCUMENTS

| | | | |
|---|---|---|---|
| 4,282,109 | 8/1981 | Citrone et al. | 252/102 |
| 4,933,101 | 6/1990 | Cilley et al. | 252/99 |
| 4,941,988 | 7/1990 | Wise | 252/99 |
| 5,130,043 | 7/1992 | Prince et al. | 252/95 |
| 5,169,552 | 12/1992 | Wise | 252/95 |
| 5,384,061 | 1/1995 | Wise | 252/95 |
| 5,403,515 | 4/1995 | Instone et al. | 252/550 |
| 5,510,047 | 4/1996 | Gabriel et al. | 252/89.1 |
| 5,531,915 | 7/1996 | Perkins | 510/294 |
| 5,591,703 | 1/1997 | Sadlowski | 510/220 |
| 5,597,789 | 1/1997 | Sadlowski | 510/230 |
| 5,602,092 | 2/1997 | Repinec, Jr. et al. | 510/434 |

FOREIGN PATENT DOCUMENTS

| | | | |
|---|---|---|---|
| 606707 | 7/1994 | European Pat. Off. | C11D 3/395 |
| WO 95/08611 | 3/1995 | WIPO | C11D 1/14 |

*Primary Examiner*—Lorna M. Douyon
*Assistant Examiner*—John M Petruncio
*Attorney, Agent, or Firm*—Richard S. Echler, Sr.; Kim William Zerby; Jacobus C. Rasser

[57] ABSTRACT

A cleaning composition is provided with effective cleaning performance and viscosity, said composition comprising a polycarboxylate polymer and a surfactant system containing a short chain surfactant and a long chain surfactant. The present invention further encompasses the use of a polycarboxylate polymer in a liquid cleaning composition.

23 Claims, No Drawings

CLEANING COMPOSITIONS

FIELD OF THE INVENTION

The present invention relates to cleaning compositions, especially to thickened liquid cleaning compositions exhibiting effective cleaning performance and viscosity.

BACKGROUND OF THE INVENTION

Efficient cleaning performance and viscosity of the cleaning compositions are two requirements which drive consumer acceptance of cleaning products. Indeed, viscosity enables cleaning compositions to remain long enough on the surface to provide an effective cleaning action. Such a requirement is of particular utility in cleaning compositions intended to be applied "as is"to non-horizontal structural surfaces such as walls, windows and sanitary fittings such as sinks, baths, showers, wash basins and WCs. More particularly, viscosities of 10 cps to 4000 cps are suitable. On the other hand, effective cleaning is important, especially on greasy and oily soils and/or where the composition is thereafter diluted.

It is therefore an object of the present invention to provide cleaning compositions having effective cleaning performance and viscosity.

The Applicant has now found that the combination of a surfactant system, comprising a short chain surfactant and a long chain surfactant, and a polycarboxylate polymer in a liquid cleaning composition fulfils such a need.

Another advantage of the present invention is that it provides stable compositions, especially in presence of a bleach component.

Another advantage of the present invention is that it provides liquid cleaning compositions which are safe to the user when said composition is sprayed onto the surface to be treated.

SUMMARY OF THE INVENTION

The present invention is a liquid cleaning composition comprising:

i)-a surfactant system comprising a short chain surfactant and a long chain surfactant, said surfactants comprising a hydrophobic portion and a hydrophilic portion, wherein the chain length of the hydrophobic portion of the short chain surfactant is $C_6$ to $C_{10}$ and the chain length of the hydrophobic portion of the long chain surfactant is $C_{11}$ to $C_{20}$ carbon atoms; and ii)-a polycarboxylate polymer;

with the proviso that where the chain length of the hydrophobic portion of the short chain surfactant is $C_6$ to $C_8$, the short chain and the long chain surfactant are present in a weight ratio of said short chain to said long chain surfactant of less than 4:1

The present invention further encompasses the use of a polycarboxylate polymer in a liquid cleaning composition, in a sprayed form, for preventing or reducing inhalation of said composition by the user as said composition is sprayed.

In a further aspect of the invention, there is provided a method for cleaning a hard surface by applying on said surface an effective amount of a composition of the present invention.

DETAILED DESCRIPTION OF THE INVENTION

Surfactant System

A surfactant system is an essential feature of the invention. The surfactant system comprises a short chain surfactant an d a long chain surfactant. All surfactants have in common that they comprise a hydrophobic portion and a hydrophilic portion.

For the purpose of the invention, where the chain length of the hydrophobic portion of the short chain surfactant is $C_6$ to $C_8$, the short chain and the long chain surfactant are present in a weight ratio of said short chain to said long chain surfactant of less than 4:1, preferably less than 2:1, more preferably less than or equal to 1:1.

Short Chain Surfactant

By short chain surfactant, it is meant herein surfactants which comprise a $C_6$–$C_{10}$ alkyl chain as their hydrophobic portion. Such short chain surfactants are accordingly those conventionally used in this field, but with a shorter alkyl chain. Suitable short chain surfactants for use herein are selected from the group consisting of $C_6$–$C_{10}$ alkyl sulphates ($C_6$–$C_{10}SO_4$), alkyl ether sulphates ($C_6$–$C_{10}(OCH_2CH_2)eSO_4$), alkyl sulphonates ($C_6$–$C_{10}SO_3$), alkyl succinates ($C_6$–$C_{10}OOCCH_2CH_2COOZ$), alkyl carboxylates ($C_6$–$C_{10}COOM$), alkyl ether carboxylates ($C_6$–$C_{10}(OCH_2CH_2)_eCOOM$), alkyl sarcosinates ($C_6$–$C_{10}CON(CH_3)R$), alkyl sulpho succinates ($C_6$–$C_{10}OOCCH(SO_3M)CH_2COOZ$), capped alkyl ethoxylates ($C_6$–$C_{10}(OCH_2CH_2)_fOR$, capped alkyl ethoxylates carboxylates ($C_6$–$C_{10}(OCH_2CH_2)_f(CH_2)COOR$, amine oxides ($C_6$–$C_{10}RR'NO$), and betaines ($C_6$–$C_{10}N+(CH_3)_2CH_2COO$—). In the formulae in brackets, e is from 0 to 20, f is from 1 to 16, preferably 1 to 5, Z is M or R, M is H or any counterion such as those known in the art, including Na, K, Li, $NH_4$, amine, R and R' are $C_1$–$C_5$ alkyl groups, possibly functionalized with hydroxyl groups, R and R' are preferably $C_1$–$C_3$, most preferably methyl. The compositions according to the present invention may comprise any of the above surfactants alone, or any combination thereof, depending on the end use envisioned.

Preferred short chain surfactants for use herein are hypochlorite compatible, e.g surfactants which contain no functionalities (such as ether linkages, unsaturation, some aromatic structures or hydroxyl groups) which are susceptible of oxidation by the hypochlorite bleach. More preferably, the short chain surfactants for use herein are anionic short chains. Preferably, the anionic short chain surfactants comprise a $C_7$–$C_9$ alkyl chain as their hydrophobic portion. Preferred anionic short chain surfactants among the one above disclosed are the alkyl sulphates and alkyl sulphonates. Most preferred anionic short chain surfactants are selected from the $C_7$–$C_9$ alkyl sulphates, $C_7$–$C_9$ alkyl sulphonates and mixtures thereof. A most preferred short chain surfactants for use herein is octyl sulphate. Such short chain anionic surfactants can be made by well known sulphation or sulphonation processes followed by neutralisation, but said anionic short chain surfactants are more conveniently commercially available, for instance from Rhone Poulenc under the trade name Rhodapon® OLS, from Witco under the trade name Witconate ®, or from Albright and Wilson under the trade name Empimin®. A preferred commercially available compound is Empimin® LV33.

According to the present invention, the compositions comprise from 0.1% to 5%, preferably 0.3% to 4% by weight, more preferably from 0.6% to 2.5% by weight, of short chain surfactants.

Long Chain Surfactants

Long chain surfactants for use herein are those which comprise a $C_{11}$–$C_{20}$ alkyl chain as their hydrophobic portion. Suitable long chain surfactants are selected from $C_{11}$–$C_{20}$ alkyl sulphates ($C_{11}$–$C_{20}SO_4$), alkyl ether sulphates ($C_{11}$–$C_{20}(OCH_2CH_2)eSO_4$), alkyl sulphonates ($C_{11}$–$C_{20}SO_3$), alkyl aryl sulphonates ($C_{11}$–$C_{20}$arylSO$_3$), alkyl succinates ($C_{11}$–$C_{20}OOCCH_2CH_2COOZ$), alkyl carboxylates ($C_{11}$–$C_{20}COOM$), alkyl ether carboxylates ($C_{11}$–$C_{20}(OCH_2CH_2)_eCOOM$), alkyl sarcosinates ($C_{11}$–$C_{20}CON(CH_3)R$), alkyl sulpho succinates ($C_{11}$–$C_{20}OOCCH(SO_3M)CH_2COOZ$), capped alkyl ethoxylates ($C_{11}$–$C_{20}(OCH_2CH_2)_fOR$, capped alkyl ethoxylates carboxylates ($C_{11}$–$C_{20}(OCH_2CH_2)_f(CH_2)COOR$, amine oxides ($C_{11}$–$C_{20}RR'NO$), and betaines ($C_{11}$–$C_{20}$N+ R1R2R3COO—) wherein R1, R2, R3 are independently C1–C6 alkyl, hydroxy alkyl or other substituted C1–C6 alkyl groups. In the formulae in brackets, e is from 0 to 20, f is from 1 to 16, preferably 1 to 5, Z is M or R, M is H or any counterion such as those known in the art, including Na, K, Li, $NH_4$, amine, R and R' are $C_1$–$C_5$ alkyl groups, possibly functionalized with hydroxyl groups, R and R' are preferably $C_1$–$C_3$, most preferably methyl. The compositions according to the present invention may comprise any of the above surfactants alone, or any combination thereof, depending on the end use envisioned.

Preferred long chain surfactants for use herein are hypochlorite compatible, e.g surfactants which contain no functionalities (such as ether linkages, unsaturation, some aromatic structures or hydroxyl groups) which are susceptible of oxidation by the hypochlorite bleach.

More preferably, the long chain surfactants for use herein are anionic long chains. Preferably, the long chain anionic surfactants for use herein comprise a $C_{11}$–$C_{18}$, more preferably a $C_{12}$–$C_{14}$ alkyl chain as their hydrophobic portion or a $C_{11}$–$C_{18}$ alkyl aryl chain, more preferably a $C_{11}$–$C_{18}$ alkyl benzene chain. Preferred anionic long chain surfactants among the one above disclosed are alkyl sulphates and/or alkyl aryl sulphonates. Most preferred are the $C_{12}$–$C_{14}$ alkyl sulphates and/or $C_{11}$–$C_{14}$ alkyl benzene sulphonates. Preferred alkyl sulphates for use herein are selected from sodium tallow alkyl sulphate, sodium lauryl sulphate and mixtures thereof. A preferred commercially available compound is Empicol® 0298/F from Albright and Wilson. Preferred alkyl aryl sulphonates for use herein are commercially available from Albright and Wilson.

Other particularly suitable long chain surfactants herein are betaine surfactants of the formula $C_{11}$–$C_{20}$N+ R1R2R3COO— wherein R1, R2, R3 are independently $C_1$–$C_6$ alkyl, hydroxy alkyl or other substituted $C_1$–$C_6$ alkyl groups, preferably C1–C4 alkyl, more preferably selected from methyl, ethyl, propyl and most preferably methyl. Suitable alkyl betaines are $C_{11}$–$C_{20}$ alkyl dimethyl betaine, preferably $C_{11}$–$C_{14}$ alkyl dimethyl betaine such as pure cut $C_{12}$ alkyl dimethyl betaine commercially available from Hoechst.

Compositions according to the present invention comprise from 0.1% to 5%, preferably from 1% to 3% by weight of the total compositions of said long chain surfactants.

Where amine oxide is used as a long chain surfactant, it is preferred for convenient use of the composition that the level of said long chain amine oxide surfactant is present at a level of from 0.1% to 2% by weight of the composition. Above such levels, the composition may tend to be too viscous to be easily usable.

Furthermore, the use of long chain amine oxide surfactants in the cleaning composition of the invention which provide effective cleaning and viscosity performance is especially surprising as the Applicant has found that in the absence of a polycarboxylate polymer, a problem encountered with the use of such amine oxide is that the activity of the short chain surfactant is hindered by said long chain amine oxide surfactant, so that the cleaning performance of the short chain surfactant does not act to its best performance.

Not to be bound by theory, it is believed that the amine oxide surfactant, especially long chain amine oxides, and the short chain surfactant are trapped in the cylindrical micellar system, formed by the amine oxide surfactants, that generates the viscosity. As a result, the short chain surfactant is not completely free to move and loses part of its cleaning power.

The Applicant has now found that the use of a polycarboxylate polymer not only overcomes the problem but also supports the cleaning efficiency of the surfactant system, even in the presence of long chain amine oxide surfactants.

Polycarboxylate Polymer

Another essential component of the invention is a polycarboxylate polymer. The polycarboxylate polymers, contrary to cellulosic polymers such as guar gum or xanthum gum, are more stable in presence of hypochlorite bleach, provide better thickening efficiency and also a higher yield value. Such high yield value is of particular utility where the composition is packaged in a spray-type dispenser.

The polymers for use herein preferably have a molecular weight of from 200.000 to 5.000.000, preferably from 500.000 to 4.500.000, more preferably from 1.000.000 to 4.000.000. Most preferred polymers for use herein contain from 0.5% to 4% by weight of a cross-linking agent, wherein the cross-linking agent tends to interconnect linear strands of the polymers to form the resulting cross-linked products. Suitable cross-linking agents include the polyalkenyl polyethers. Polycarboxylate polymers include the polyacrylate polymers. Other monomers besides acrylic acid can be used to form these polymers including such monomers as maleic anhydride which acts as a source of additional carboxylic groups. The molecular weight per carboxylate group of monomers containing a carboxylate group typically varies from 25 to 200, preferably from 50 to 150, more preferably from 75 to 125. Further other monomers may be present in the monomeric mixture, if desired, such as ethylene and propylene which act as diluents.

Preferred polycarboxylate polymers for use herein are the polyacrylate polymers. Commercially available polymers of the polyacrylate type include those sold under the trade names Carbopol®, Acrysol® ICS-1, Polygel®, and Sokalan®. Most preferred polyacrylate polymers are the copolymer of acrylic acid and alkyl ($C_5$–$C_{10}$) acrylate, commercially available under the tradename Carbopol® 1623, Carbopol® 695 from BF Goodrich, and copolymer of acrylic acid and maleic anhydride, commercially available under the tradename Polygel® DB, Polygel® DV, Polygel® DA, from 3V Chemical company.

Mixtures of any of the polycarboxylate polymers, herein before described, may also be used.

The polymer is present in an amount of from 0.1% to 4% by weight, preferably 0.3 to 4% by weight, more preferably 0.4% to 1.5% by weight of the composition.

The Applicant has now surprisingly found that the present polymer performs dual functions when it is incorporated in the composition herein, said functions being not only to thicken but also to support the cleaning performance of the surfactant system.

Optional Components

The compositions according to the present invention may comprise a number of optional ingredients such as bleaching agents, fatty acids, radical scavengers, antimicrobial compounds, builders, chelants, buffers, bactericides, solvents, enzymes, hydrotropes, colorants, bleach activators, soil suspenders, dye transfer agents, brighteners, anti dusting agents, dispersants, dye transfer inhibitors, pigments, perfumes and dyes.

A highly preferred optional ingredient according to the present invention is a hypochlorite bleaching agent, preferably an alkali metal hypochlorite. Advantageously, the compositions of the invention are stable in presence of this bleaching agent. Although alkali metal hypochlorites are preferred other hypochlorite compounds may also be used herein and can be selected from calcium and magnesium hypochlorite. A preferred alkali metal hypochlorite for use herein is sodium hypochlorite. Compositions according to the present invention comprise said hypochlorite bleaching agents such that the content of active chlorine in the compositions is from 0.1% to 4%, preferably from 1% to 2% by weight.

Another optional component of the present invention is an alkali metal salt of a $C_8$–$C_{18}$ fatty acid. Said fatty acids are used as suds suppressors. Suitable fatty acids for use herein can be any $C_8$–$C_{18}$ fatty acid, preferably fully saturated, preferably a sodium, potassium or lithium salt, more preferably the sodium salt. Suitable fatty acids may be selected from caprylic acid, capric acid, lauric acid, myristic acid, palmitic acid, stearic acid and mixtures of fatty acids suitably hardened, derived from natural sources such as tallow, coconut oil, ground oil and babassu oil. Compositions according to the present invention comprise from 0.1% to 2%, preferably less than 0.6% by weight of the composition of fatty acids.

A further optional component of the present invention is a radical scavenger. Said radical scavengers are used as stabilisers. A suitable radical scavenger for use herein is the aromatic molecule containing a carboxylic group ring substitution. Suitable examples of radical scavengers for use herein include the meta and para-chlorobenzoic acid, benzoic acid, meta- ortho- and para-methoxybenzoic acid, meta nitrobenzoic acid, para bromobenzoic acid, salicylic acid, 5-sulphosalicylic acid, 3,5-dimethyl salicylic acid and paratoluic acid. Of the above materials, ortho-methoxybenzoic acid is preferred. Compositions according to the present invention comprise from 0.01% to 1.5% by weight, preferably from 0.1% to 0.8% by weight and more preferably from 0.2% to 0.5% by weight of the composition of radical scavengers.

An optional requirement of the compositions according to the present invention is that the pH is greater than 10, preferably greater than 11, more preferably greater than 12. This is achieved by the addition of from 0.4% to 2% of a caustic alkali. Suitable caustic alkalis for use herein include sodium and potassium hydroxide. Compositions according to the present invention comprising hypochlorite preferably have a pH greater than 12 for hypochlorite stability.

The compositions according to the present invention are preferably aqueous and preferably comprise from 80% to 95%, more preferably from 85% to 90% of water.

The compositions according to the present invention are prepared by methods well known in the art such as the methods described in GB 1 329 086 with the exception of the polymer being pre-dispersed in an acidic water solution of pH 3 and then neutralised up to pH 7 before starting adding the other components. The compositions according to the present invention can then be prepared by mixing all of the ingredients in a non-metallic apparatus at room temperature or in warm water. If fatty acid is used, it is melted before being added to the mixture. Preferably, the surfactant blend is first prepared by adding the short chain surfactant to the long chain surfactants. Other optionals such as perfume and the alkali metal hypochlorite are then added whilst stirring. Colourants if present, are added after all the other ingredients have been mixed.

The compositions according to the present invention preferably have a viscosity of from 10 cps to 4000 cps, more preferably from 50 cps to 2000 cps, most preferably from 150 cps to 1000 cps measured with a Carrimed Rheometer at a temperature of 25° C. and a shear rate of 15–35 $s^{-1}$. Where the composition is in a sprayed form, the viscosity of said spraying compositions is preferably of from 15 cps to 40 cps.

The compositions of the present invention may be used for a variety of cleaning purposes such as cleaning hard surfaces whereby said compositions thickened nature results in longer adhesion to the surface than non-thickened compositions. By "hard surface" it is meant herein any surface like bathroom, sanitary fittings such as sinks, showers, wash basins and WCs, kitchen, sinks, cooker tops, table tops, refrigerators, walls, windows and the like.

Packaging Form of the Compositions

The compositions herein may be packaged in a variety of suitable detergent packaging known to those skilled in the art. The liquid compositions herein may desirably be packaged in manually operated spray dispensing containers, which are usually made of synthetic organic polymeric plastic materials. Accordingly, the present invention also encompasses liquid cleaning compositions of the invention packaged in a spray dispenser, preferably in a trigger spray dispenser. Indeed, said spray-type dispensers allow to uniformly apply to a relatively large area of a surface to be cleaned the liquid cleaning compositions suitable for use according to the present invention; thereby contributing to the cleaning properties of said compositions. Such spray-type dispensers are particularly suitable to clean vertical surfaces. Surprisingly, the spraying of a liquid composition containing a polycarboxylate polymer, contrary to compositions which do not contain the polycarboxylate polymer, has been seen beneficial for preventing or reducing inhalation of the composition by the user as said composition is sprayed.

The present advantage is preferably observed where the cleaning composition is as defined hereinbefore. Accordingly, the use of a polycarboxylate polymer in a liquid cleaning composition is provided, said composition being in a sprayed form, for preventing or reducing inhalation of said composition by the user as said composition is sprayed. Preferably, the liquid cleaning composition is as defined hereinbefore.

Suitable spray-type dispensers to be used according to the present invention include manually operated foam trigger-type dispensers sold for example by Specialty Packaging Products, Inc. or Continental Sprayers, Inc. These types of dispensers are disclosed, for instance, in U.S. Pat. No. 4,701,311 to Dunnining et al. and U.S. Pat. No. 4,646,973 and U.S. Pat. No. 4,538,745 both to Focarracci. Particularly preferred to be used herein are spray-type dispensers such as T 8500® or T 8900® commercially available from Continental Spray International or T 8100 ® commercially available from Canyon, Northern Ireland. In such a dispenser the liquid composition is divided in fine liquid droplets resulting in a spray that is directed onto the surface to be treated. Indeed, in such a spray-type dispenser the composition contained in the body of said dispenser is directed through the spray-type dispenser head via energy communicated to a pumping mechanism by the user as said user activates said pumping mechanism. More particularly, in said spray-type dispenser head the composition is forced against an obstacle, e.g. a grid or a cone or the like, thereby providing shocks to help atomise the liquid composition, i.e. to help the formation of liquid droplets.

The present invention further encompasses a method for cleaning a hard surface by applying on said surface an effective amount of a composition of the invention. The said composition may be applied in its neat form or after having been diluted with water. Preferably said composition is diluted up to 200 times its weight of water, preferably into 50 to 150 times its weight of water and more preferably 75 to 95, before it is applied to said surface. When the composition is diluted prior to use (to reach a total active level in the order of 1.2%), the composition will still advantageously provide effective cleaning performance. In the preferred embodiment of the method of the present invention wherein said composition is applied to a hard-surface to be cleaned in its diluted form, it may not be necessary to rinse the surface after the composition has been applied.

In the detergent compositions of the invention, the abbreviated component identifications have the following meaning:

C8 AS: Octyl sulphate, available from Albright and Wilson, under the tradename Empimin® LV33

Alkyl betaine: C12 alkyl dimethyl betaine commercially available from Hoechst

HLAS: C11–C14 alkyl benzene sulphonate available from Albright and Wilson

24 AS: Sodium $C_{12}$–$C_{14}$ alkyl sulphate, available from Albright and Wilson, under the tradename Empicol® 0298/F 24E3S: $C_{12}$–$C_{14}$ sodium alkyl sulphate condensed with an average of 3 moles of ethylene oxide per mole Amine oxide: $C_{12}$–$C_{14}$ amine oxide, commercially available under the tradename Genaminox® LA from Hoechst Polymer: Copolymer of acrylic acid and alkyl ($C_5$–$C_{10}$) acrylate, commercially available under the tradename Carbopol® 1623 from BF Goodrich or copolymer of acrylic acid and maleic anhydride, commercially available under the tradename Polygel® DA from 3V Sigma company.

Fatty acid: $C_8$–$C_{18}$ fatty acid nonionic: Capped ethoxylated carboxylate of formula C12–$C_{14}(OCH_2CH_2)_xCH_2COOR$, wherein x is an integer ranging from 2 to 4

The invention is illustrated in the following non-limiting examples, in which all percentages are on a weight basis unless otherwise stated.

EXAMPLE 1

The following compositions, according to the invention, were prepared:

| Components | A | B | C | D | E | F | G |
|---|---|---|---|---|---|---|---|
| 24 AS | 1.0 | 1.0 | 2.0 | 2.0 | 1.0 | 1.0 | 1.0 |
| C8 AS | 1.0 | 1.0 | 1.0 | 2.0 | 2.0 | 2.0 | 2.0 |
| Polymer | 0.8 | 0.8 | 1.2 | 1.0 | 1.0 | 1.5 | 0.3 |
| Caustic | — | 1.4 | 1.4 | 1.5 | 1.4 | — | 1.0 |
| Sodium hypochlorite | — | 1.4 | 1.0 | 1.0 | 1.4 | 1.4 | 1.4 |
| Fatty acid | — | 0.2 | 0.3 | 0.3 | 0.2 | — | — |
| Water and minors up to 100 | | | | | | | |

EXAMPLE 2

The following compositions are in accordance with the invention

| | H | I | J | K | L |
|---|---|---|---|---|---|
| C8 AS | 1.0 | 1.0 | 2.0 | 2.0 | 2.0 |
| 24AE3S | 2.0 | 2.0 | 1.0 | 1.0 | 1.0 |
| Polymer | 0.8 | 1.0 | 1.2 | 1.0 | 0.4 |
| nonionic | 0.5 | 0.5 | 1.0 | 1.0 | 0.5 |
| fatty acid | 0.3 | 0.3 | 0.3 | 0.3 | 0.3 |
| Caustic | 1.4 | 1.4 | 1.4 | 1.4 | 1.0 |
| sodium hypochlorite | 1.4 | 1.6 | 1.6 | 1.4 | 1.4 |
| Water and minors up to 100 | | | | | |

EXAMPLE 3

The following compositions are in accordance with the invention

| | M | N | O | P | Q | R |
|---|---|---|---|---|---|---|
| amine oxide | 0.4 | 0.4 | 0.8 | — | — | — |
| 24 AS | — | 2.0 | 2.0 | — | — | — |
| AIkyl betaine | — | — | — | 2.0 | — | — |
| HLAS | — | — | — | — | 2.0 | 2.0 |
| C8 AS | 2.0 | 2.0 | 2.0 | 1.5 | 1.5 | 2.0 |
| Polymer | 0.8 | 0.8 | 0.8 | 1.1 | 1.1 | 0.8 |
| Caustic | 1.4 | 1.4 | 1.4 | 1.1 | 1.1 | 1.1 |
| Sodium hypochlorite | 1.4 | 1.4 | 1.4 | 1.1 | 1.1 | 1.4 |
| Water and minors up to 100 | | | | | | |

EXAMPLE 4

The following compositions were made and packaged in a spray-trigger dispenser T 8500®:

| | S | T | U | V | X |
|---|---|---|---|---|---|
| CS AS | 2.0 | 2.0 | 3.0 | 1.5 | 2.0 |
| HLAS | — | — | — | 2.0 | 0.5 |
| 24AS | 1.0 | — | 0.3 | — | — |
| 24AE3S | — | 1.0 | — | — | — |
| Polymer | 0.3 | 0.4 | 0.4 | 0.3 | 0.4 |
| nonionic | — | 0.5 | — | — | — |
| fatty acid | — | 0.3 | — | 0.1 | 0.1 |
| Caustic | 1.0 | 1.0 | 1.0 | 1.0 | 1.0 |
| sodium hypochlorite | 1.4 | 1.4 | 1.4 | 1.1 | 1.1 |
| Water and minors up to 100 | | | | | |

The above compositions, in a sprayed form, exhibited reduced inhalation of said composition by the user as said composition was sprayed as compared to compositions, in a sprayed form, which did not contain the polycarboxylate polymer.

We claim:

1. A liquid cleaning composition comprising:

a) from 0.2% to 10% by weight, of a surfactant system comprising:

i) a short chain surfactant, said surfactant comprising a hydrophobic portion having a chain length of from 6 to 8 carbon atoms;

ii) a long chain surfactant, said surfactant comprising a hydrophobic portion having a chain length of from 11 to 20 carbon atoms; provided the weight ratio of short chain surfactant to long chain surfactant is less than 4:1;

b) from 0.1% to 4% by weight, of a polycarboxylate polymer; and c) the balance carriers and other adjunct ingredients.

2. A composition according to claim 1 wherein said short chain surfactant is selected from the group consisting of alkyl sulphates, alkyl sulphonates, and mixtures thereof.

3. A composition according to claim 1 wherein said short chain surfactant hydrophobic portion comprises from 7 to 8 carbon atoms.

4. A composition according to claim 1 comprising from 0.3% to 4% by weight, of the cleaning composition, a short chain surfactant.

5. A composition according to claim 4 comprising from 0.6% to 2.5% by weight, of the cleaning composition, a short chain surfactant.

6. A composition according to claim 1 wherein said long chain surfactant is selected from the group consisting of alkyl betaine surfactants, amine oxides, anionic surfactants, and mixtures thereof.

7. A composition according to claim 6 wherein said long chain surfactant hydrophobic portion comprises from 11 to 18 carbon atoms.

8. A composition according to claim 7 wherein said long chain surfactant hydrophobic portion comprises from 12 to 14 carbon atoms.

9. A composition according to claim 1 comprising from 1% to 3% by weight, of the cleaning composition, a short chain surfactant.

10. A composition according to claim 1 wherein said polycarboxylate polymer is a polyacrylate polymer.

11. A composition according to claim 1 comprising from 0.3% to 4% by weight, of said polycarboxylate polymer.

12. A composition according to claim 11 comprising from 0.4% to 1.5% by weight, of said polycarboxylate polymer.

13. A composition according to claim 1 further comprising a hypochlorite bleaching agent in an amount sufficient to provide from 0.1% to 4% by weight, of said cleaning composition, active chlorine.

14. A composition according to claim 1 wherein said composition has a viscosity of from 10 cps to 4000 cps.

15. A liquid cleaning composition comprising:

a) from 0.2% to 10% by weight, of a surfactant system comprising:

i) a short chain surfactant, said surfactant comprising a hydrophobic portion having a chain length of from 6 to 8 carbon atoms;

ii) a long chain surfactant, said surfactant comprising a hydrophobic portion having a chain length of from 11 to 20 carbon atoms; provided the weight ratio of short chain surfactant to long chain surfactant is less than 4:1;

b) from 0.1% to 4% by weight, of a polycarboxylate polymer; and c) the balance carriers and other adjunct ingredients wherein said composition has a viscosity of from 10 cps to 4000 cps.

16. A composition according to claim 15 further comprising a hypochlorite bleaching agent in an amount to provide from 0.1% to 4% by weight, of said cleaning composition, active chlorine.

17. A composition according to claim 15 wherein said polycarboxylate polymer is a polyacrylate polymer having a molecular weight of from 200,000 daltons to 5,000,000 daltons.

18. A liquid cleaning composition comprising:

a) from 0.2% to 10% by weight, of a surfactant system comprising:

i) a short chain surfactant comprising a hydrophobic portion having a chain length of from 6 to 8 carbon atoms, said short chain surfactant is selected from the group consisting of alkyl sulphates, alkyl sulphonates, and mixtures thereof;

ii) a long chain surfactant comprising a hydrophobic portion having a chain length of from 11 to 20 carbon atoms, said long chain surfactant is selected from the group consisting of alkyl betaine surfactants, amine oxides, anionic surfactants, and mixtures thereof; provided the weight ratio of short chain surfactants to long chain surfactants is less than 4:1;

b) from 0.1% to 4% by weight, of a polycarboxylate polymer, said polycarboxylate polymer is a polyacrylate polymer having a weight of from 200,000 daltons to 5,000,000 daltons;

c) a hypochlorite bleaching agent in an amount sufficient to provide from 0.1% to 4% by weight, of said cleaning composition, active chlorine, and d) the balance carriers and other adjunct ingredients, said adjunct ingredients selected from the group consisting of fatty acid salts, radical scavengers, and mixtures thereof;

wherein said compositions has a viscosity of from 10 cps 4000 cps and a pH greater than 10.

19. A composition according to claim 18 comprising from 0.3% to 4% by weight, of said polycarboxylate polymer.

20. A composition according to claim 19 comprising from 0.4% to 1.5% by weight, of said polycarboxylate polymer.

21. A composition according to claim 18 wherein said long surfactant hydrophobic portion comprises from 11 to 18 carbon atoms.

22. A composition according to claim 21 wherein said long chain surfactants hydrophobic portion comprises from 12 to 14 carbon atoms.

23. A composition according to claim 18 comprising from 1% to 3% by weight, of the cleaning composition, a short chain surfactant.

* * * * *